United States Patent [19]

Weeks

[11] Patent Number: 4,790,376

[45] Date of Patent: Dec. 13, 1988

[54] DOWNHOLE JET PUMP

[75] Inventor: Benjamin R. Weeks, Corpus Christi, Tex.

[73] Assignee: Texas Independent Tools & Unlimited Services, Inc., Corpus Christi, Tex.

[21] Appl. No.: 935,819

[22] Filed: Nov. 28, 1986

[51] Int. Cl.[4] ..... E21B 43/00

[52] U.S. Cl. ..... 166/68; 166/106; 417/172

[58] Field of Search ..... 166/68, 105, 106, 372; 417/172

[56] References Cited

U.S. PATENT DOCUMENTS

| | | | |
|---|---|---|---|
| 1,992,436 | 2/1935 | McMahon | 417/172 |
| 2,061,865 | 11/1936 | Wells | 166/372 |
| 2,080,622 | 5/1937 | McMahon | 417/172 |
| 2,290,141 | 7/1942 | Burt | 166/106 |
| 2,291,911 | 8/1942 | McMahon | 417/172 |
| 2,370,413 | 2/1945 | Nation | 417/172 |
| 2,463,317 | 3/1949 | Sanders | 417/172 |
| 3,746,089 | 7/1973 | Vencil | 166/106 |
| 3,974,878 | 8/1976 | Roeder et al. | 166/372 |
| 3,991,825 | 11/1976 | Morgan | 166/68 |
| 4,603,735 | 8/1986 | Black | 166/68 |

*Primary Examiner*—Hoang C. Dang

*Attorney, Agent, or Firm*—G. Turner Moller

[57] ABSTRACT

A hydrocarbon producing well is pumped with a jet pump device. The jet pump is set below a packet in the well. A power fluid conduit leads from a location above the packer to the power fluid inlet of the jet pump. A produced fluids conduit leads from the outlet of the jet pump to a location above the packer. In one embodiment, power fluid is injected down the annulus and produced fluids go up the tubing. In a second embodiment, power fluid is injected down the tubing and produced fluids go up the annulus.

4 Claims, 3 Drawing Sheets

DOWNHOLE JET PUMP

This invention relates to a system for pumping oil and other formation liquids from a well and, more particularly to a well pumping system incorporating an ejector or venturi.

The standard oil well pumping system incorporates a down hole pump, a sucker rod string extending from the down hole pump to the surface and a pump jack at the surface attached to the upper end of the sucker rod string for reciprocating the sucker rods thereby activating the down hole pump. This system has worked well for most applications for many years and has become the standard of the oil field. There are, however, a number of situations where this system has substantial disadvantages. Standard sucker rod installations do not work well, in a technical sense, where the formation produces a large quantity of sand or where the amount of produced formation liquid is very large. There are no real good solutions for pumping wells which make a large quantity of sand. In high volume situations, powered down hole pumps, like Reda or Kobe brand pumps, or gas lift installations have proved economic.

Standard sucker rod installations do not work well, in an economic sense, where the amount of formation liquid is very small because the standard pump jack is so expensive. In a normal pumping well situation, the longevity of the well and the maintenance requirements of the pump jack are such that it makes perfect sense to expend considerable capital to design and manufacture pump jacks of exquisite construction having long lives and low maintenance costs. This does not make sense, of course, in very low volume wells because they may not be able to stand the cost of the pump jack and other equipment.

There have been many proposals suggesting pumping arrangements other that conventional pump jack-sucker rod installations. It is a tribute to the engineering efforts spent on conventional pump jacks, sucker rods and down hole pumps that these proposals, with several exceptions, have not been accepted to any appreciable extent.

One class of unorthodox oil well pumping arrangements that has been proposed and used to a considerable extent is a down hole ejector or venturi which is operated by delivering compressed air or natural gas down the well to the venturi. The compressed gas passes into the venturi power inlet while formation fluids pass into the venturi suction. A mixture of compressed gas and formation fluid is delivered upwardly through the outlet of the venturi into the bottom of the tubing string, typically past a standing valve. Disclosures of this general type are found in U.S. Pat. Nos. 1,604,644 and 1,757,381. A modification of this theme is found in U.S. Pat. Nos. 1,355,606 and 1,758,376 where a liquid is used as the power fluid. Also of some interest are the disclosures in U.S. Pat. Nos. 1,150,473; 2,287,076; 2,826,994; 3,215,087; 3,887,008; 4,183,722; 4,293,283 and 4,390,061. It is this type device which this invention most nearly relates.

One of the peculiarities of the prior art jet pumps is that they are run immediately above a packer, if a packer is run in well. This limits the position of the suction inlet to a location immediately above the packer. Although proposals have been made to provide a tail pipe extending downwardly from the packer to a location adjacent or below the perforations, this solution is limited to the effective extent of the tailpipe. As will be more fully apparent hereinafter, one of the principal advantages of this invention is the positioning of the jet pump below the packer and providing separate passages, below the packer, for power fluid and for the mixture of power fluid and produced fluid. By this technique, the suction inlet of the jet pump may be placed well below the perforations thereby substantially eliminating back pressure against the formation. Because jet pumps are remarkably tolerant of produced sand, it will be evident that such a system provides many advantages.

In summary, one aspect of this invention resides in equipping a well with a downhole jet pump so the pump is located below a packer used to seal between a tubing and a casing string. In this fashion, the fluid suction may be located below the casing perforations. If the jet pump is sized to exceed the productive capacity of the formation, this location below the perforations will effectively eliminate any back pressure on the formation and allow the jet pump to apply a vacuum thereto.

It is accordingly an object of this invention to provide an improved method and apparatus for jet pumping liquids from a productive subterranean formation.

Another object of this invention is to provide an improved down hole jet pump assembly for pumping formation liquids to the surface by placing the jet pump below a packer.

Other objects and advantages of this invention will become more fully apparent as this description proceeds, reference being made to the accompanying drawings and appended claims.

IN THE DRAWINGS

Figure 1:
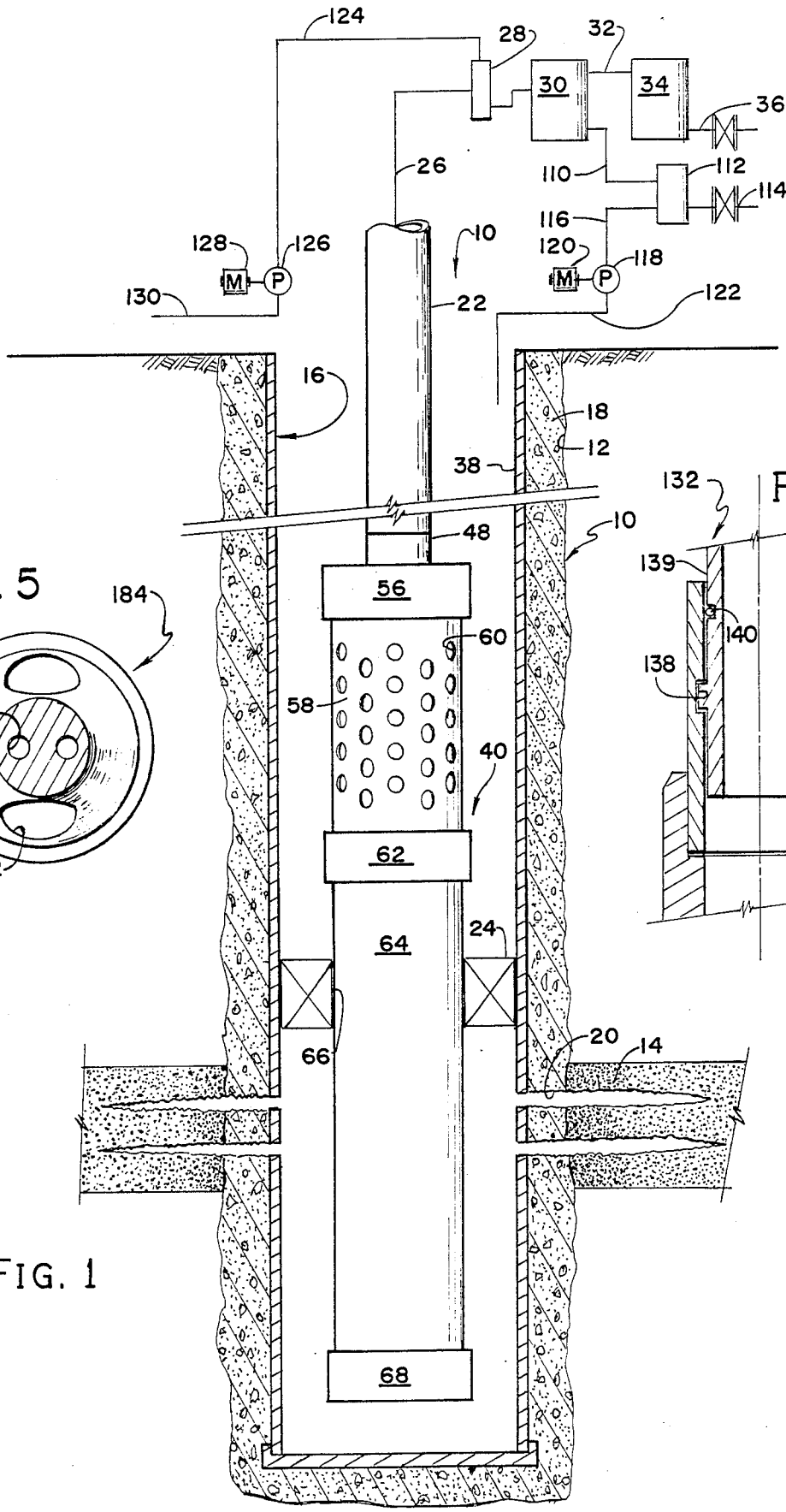
FIG. 1 is a cross-sectional view of a well equipped with a jet pumping mechanism of this invention, illustrating a first embodiment of this invention.

Referring to FIG. 1, a well 10 comprises a bore hole 12 extending into the earth to a depth sufficient to penetrate an oil productive subterranean formation 14. A casing string 16 has been cemented in the bore hole 12 with a cement sheath 18 in a conventional manner. After the casing string 16 has been cemented, a conventional perforating gun (not shown) is used to provide a series of perforations 20 communicating between the formation 14 and the interior of the casing string 16.

A tubing string 22 is run into the well 10 having a packer 24 adjacent the lower end thereof for sealing against the casing string 16. The packer 24 may be of any suitable type but must be able to withstand the pressure differential caused by the jet pump. The tubing string 22 may include conventional API tubing joints having a pin on one end and a collar or the other. In the alternative, to produce a shallow oil productive formation, the tubing string 22 may comprise a conduit of organic polymeric material of considerable length. At present, polyethylene tubing is available in 500′ spools and such material may comprise suitable tubing for shallow well installations using the technique of this invention.

At the surface, the tubing string 22 is suspended from a well head (not shown) and connects to a flow line 26 leading to a gas-liquid separator 28 and then to an oil-water separator 30, such as a conventional gun barrel. Inside the gun barrel 30, oil and water separate by gravity with oil overflowing through an outlet 32 to an oil storage tank or tanks 34 which is periodically run to sales through a valved outlet 36. It will accordingly be seen that any oil produced from the well 10 is accumulated in the tank 34 and sold therefrom.

In the embodiment of FIG. 1, the mixture of produced and power fluids are delivered upwardly through the tubing string 22 and the power fluid is delivered downwardly through the annulus 38 between the casing and tubing strings 16, 22. Mounted on the bottom of the tubing string 22 is a pump assembly 40 of this invention comprising a jet pump 42 below the packer 24 and first and second conduits 44, 46 extending between the jet pump 42 and the tubing string 22. The conduits 44, 46 deliver power fluid and the mixture of produced and power fluids through the packer 24 to and from the jet pump 42.

The sizes of the conduits 44, 46 may vary widely depending on the size of the casing string 16 and the desired capacity of the pump assembly 40. Typically, the conduit 44 comprises a polished bore receiver 48 of $2\frac{3}{8}''$ O.D. to match the size of the tubing string 22 and having a threaded upper end connected to a collar 50 receiving the lowermost pin of the tubing string 22 and a threaded lower end received in the upper end of a combination collar 52 having an upper $2\frac{3}{8}''$ female end and a lower end sized to receive a $2\frac{7}{8}''$ pin. The polished bore receiver 48 is characterized by a polished internal surface 54 for purposes more fully explained hereinafter. Threaded into the lower end of the combination collar 52 is a perforated pup joint 58 having a series of apertures 60 therein providing a passage across the wall of the first conduit 44.

Figure 2:
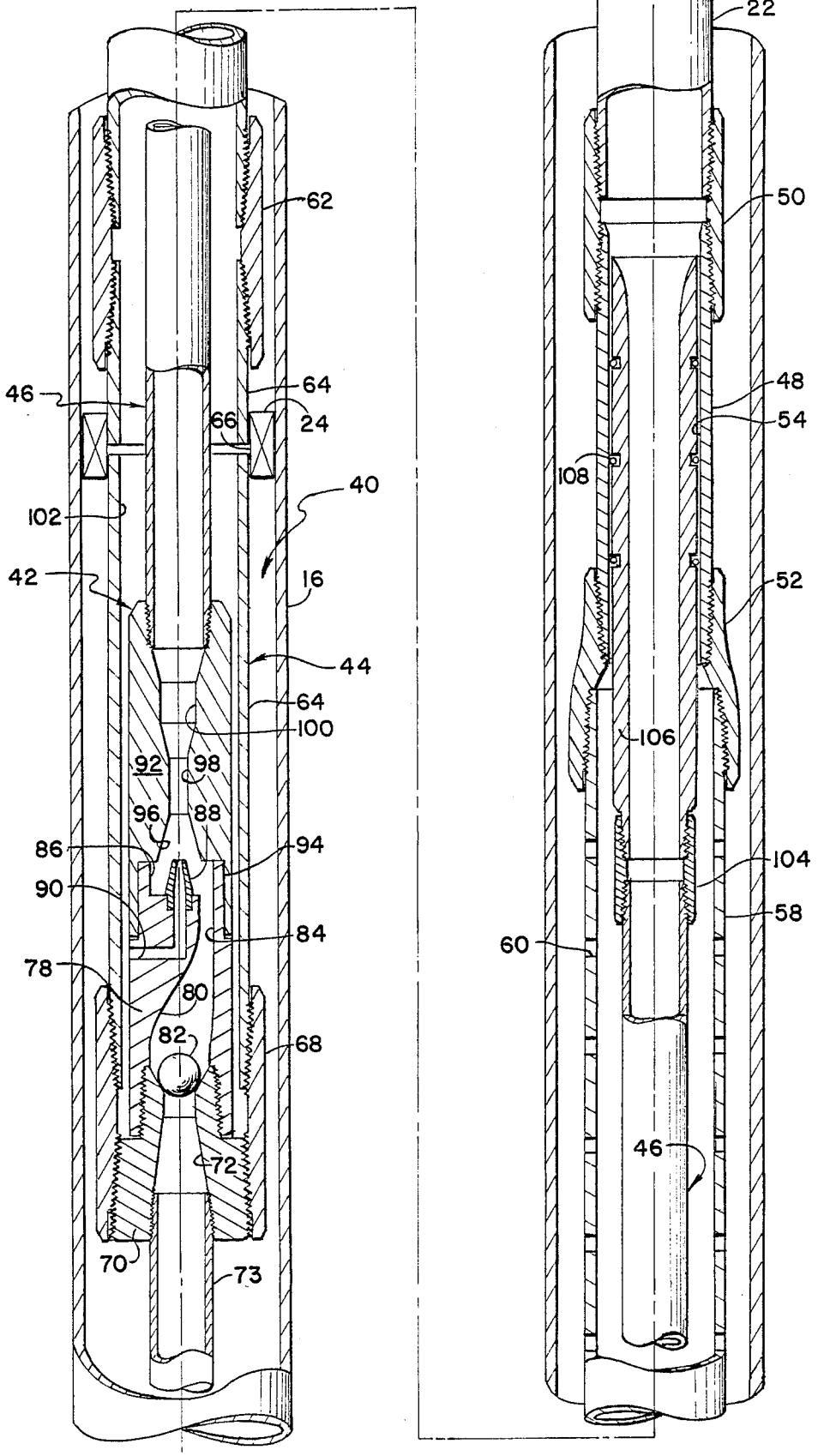
FIG. 2 is an enlarged cross-sectional view of the jet pumping mechanism of FIG. 1.

The lower end of the perforated joint 58 is received in a collar 62 having a stinger 64 threaded therein. In some packer installations, the stinger 64 may extend through a central passage of the packer 24 as suggested schematically in FIG. 1. In other packer installations, as shown in FIG. 2, an upper section of the stinger 64, typically $2\frac{7}{8}''$ O.D. tubing, threads into or onto an upper end of the packer 24 while a lower section of the stinger 64 threads into the lower end of the packer 24. Thus, the stinger 64 and the central passage 66 of the packer 24 provide a passage through the packer 24. The bottom of the stinger 64 connects to a collar 68 at the bottom of the assembly 40.

Threaded into the collar 68 is a check valve 70 having a central axial passage 72. As will be more fully apparent hereinafter, the passage 72, which may connect to a tail pipe 73, comprises the suction inlet of the jet pump 42. Received on a threaded central section 76 of the check valve 72 is a lower body section 78 of the jet pump 42 providing a inlet compartment 80 receiving a ball check 82 therein and a passage 84 leading from the inlet compartment 80 to a nozzle compartment 86 intermediate the ends of the jet pump 40. A nozzle tip 88 is conveniently secured, as by swedging or threading, in the end of a power fluid inlet passage 90 opening through the side of the lower body section 78. It will be seen that the passage 90 is the power fluid inlet of the jet pump 42.

The nozzle compartment 86 is located at the boundary of the lower and upper body sections 78, 92 which are conveniently connected in any suitable manner, as by swedging or threading. It is preferred that this connection be made by swedging which comprises machining a pair of cooperating generally cylindrical surfaces 94 on the body sections 78, 92. The inner surface 94 is slightly larger than the outer surface. By heating the body section 98 and cooling the body section 78, the body section 98 can be slipped over the body section 78 and the body sections brought back to ambient temperature to firmly secure the sections 78, 92 together.

The upper body section 92 includes a downwardly frustoconical opening 96 at least partially receiving the nozzle tip 88, a passage 98 opening into the apex of the opening 96 and known as the throat, and a diffuser section 100 as will be evident to those skilled in the art.

The upper end of the upper body section 92 is threaded to receive the lower end of the second conduit 46, which may conveniently comprise a length of 1" O.D. tubing which is substantially coaxial to the first conduit 44 providing an annulus 102 therebetween providing communication between the perforated joint 58 and the power fluid inlet passage 90. It will accordingly be seen that the first and second conduits 44, 46 provide a first passageway extending through the packer 24 for the downward movement of power fluid through the packer 24 and a second passageway through the packer 24 for the upward movement of produced and power fluid.

The upper end of the second conduit 46 is sealed relative to the first conduit 44 and the tubing string 22 in the sense that fluid in the conduit 44 and/or tubing string 22 does not enter the annulus 102. To this end, a collar 104 and sealing section or stinger 106 are provided on the upper end of the second conduit 46 to seal against the inner polished surface 54 of the polished bore receiver 48. The stinger 106 accordingly includes a series of annular circumferential grooves therein receiving packing assemblies 108.

Operation of the embodiment of FIG. 2 should now be apparent. The pump assembly 40 is run into the well on the bottom of the tubing string 22 and the packer 24 is landed at a location above the perforations 20. The lengths of the first and second conduits 44, 46 which extend below the packer 24 have been preselected to position the jet pump 42 at or preferably substantially below the lowermost perforation 20. It will be seen that the lengths of the first and second conduits 44, 46 may be substantial and are limited only by the friction losses which occur in the relatively small flow passages provided thereby. Thus, the jet pump 42 may be placed several hundreds of feet below the packer 24, which may be desirable when there is a long perforated productive interval in the well 10 as is common in many hydrocarbon producing areas of the world.

After the jet pump assembly 40 is in place in the well 10, power fluid is delivered downwardly through the annulus 38 provided between the casing and tubing strings 16, 22. The power fluid passes through the apertures 60 in the perforated joint 58 and passes downwardly in the annulus 102 to the power fluid inlet passage 90 into the jet pump 42. The power fluid exits through the nozzle tip 88 and mixes with formation fluids in the throat 98. The mixed fluids then move upwardly through the throat 98 and diffuser 100 into the second conduit 46 and then into the tubing string 22. The mixed fluids then pass into the flow line 26 and into the gas-liquid separator 28. Gas is taken off the top of the separator 28 while the produced liquids exit through the bottom into the oil-water separator or gun barrel 30.

One preferred liquid to use as the power liquid is clean field salt water from the gun barrel 30. This salt water is readily available and is inexpensive, when compared to keeping enough oil on hand to provide the power fluid. To this end, salt water is drawn off the gun barrel 30 through a flow line 110 into a storage tank 112. In the event the storage tank 112 threatens to overflow, water may be trucked off or otherwise disposed of through a valved outlet 114. Water for power fluid purposes is taken off through a flow line 116 leading to a pump 118 powered by a suitable motor 120. Relatively high pressure water accordingly moves in a flow line 122 through the well head (not shown) into the annulus.

In the event the formation 14 produces a significant quantity of natural gas, gas comes off the gas-liquid separator 28 through a flow line 124 to a flare installation (not shown) or to a compressor 126 driven by a prime mover 128 and then to a sales line 130.

Figure 3:
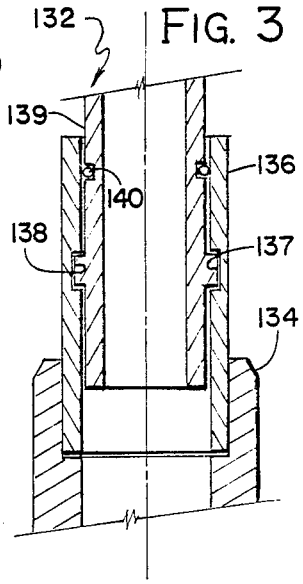
FIG. 3 is an enlarged cross-sectional view of another embodiment of this invention.

The embodiment of FIG. 2 is preferred when the jet pump 42 is not placed a great distance below the packer 24 because there is some inconvenience in running two strings of concentric tubing in the hole. Where the jet pump 42 is to be placed a substantial distance below the packer 24, the embodiment of FIG. 3 is preferred. The embodiment of FIG. 3 is identical with the embodiment of FIG. 2 except that a J-slot arrangement 132 is used in lien of threads to connect the upper end 134 of the jet pump to the second conduit. The J-slot arrangement 132 comprises a conventional J-slot receptacle 136 swedged into the upper end 134 of the pump body having a J-slot 137 therein. After the jet pump, the first conduit, and the packer are run into the hole and the collar analogous to the collar 62 is sticking up out of the rotary table, the second conduit having a J-slot pin 139 is run inside the first conduit until the dog 138 is coupled into the J-slot 137. In coupling the pin 139 to the receptacle 136, the seal or seals 140 sealably engage the interior of the receptacle 136.

In the embodiment of FIGS. 1–3, power fluid is delivered downwardly through the annulus between the casing and tubing strings 16, 22 and a commingled stream of produced and power fluid is delivered upwardly through the tubing string 22. In some circumstances, it is desireable to deliver power fluid downwardly through the tubing string 22 and deliver a commingled stream of power and produced fluids upwardly through the annulus. The reason is that the annulus between the casing and tubing strings provides a considerably larger cross-sectional area flow path to match the larger commingled stream of produced and power fluid.

Figure 5:
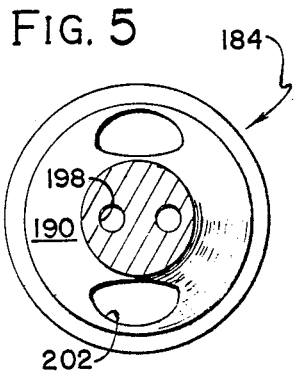
FIG. 5 is an enlarged transverse cross-sectional view of FIG. 4, taken substantially along line 4—4 thereof, as viewed in the direction indicated by the arrows.
Figure 4:
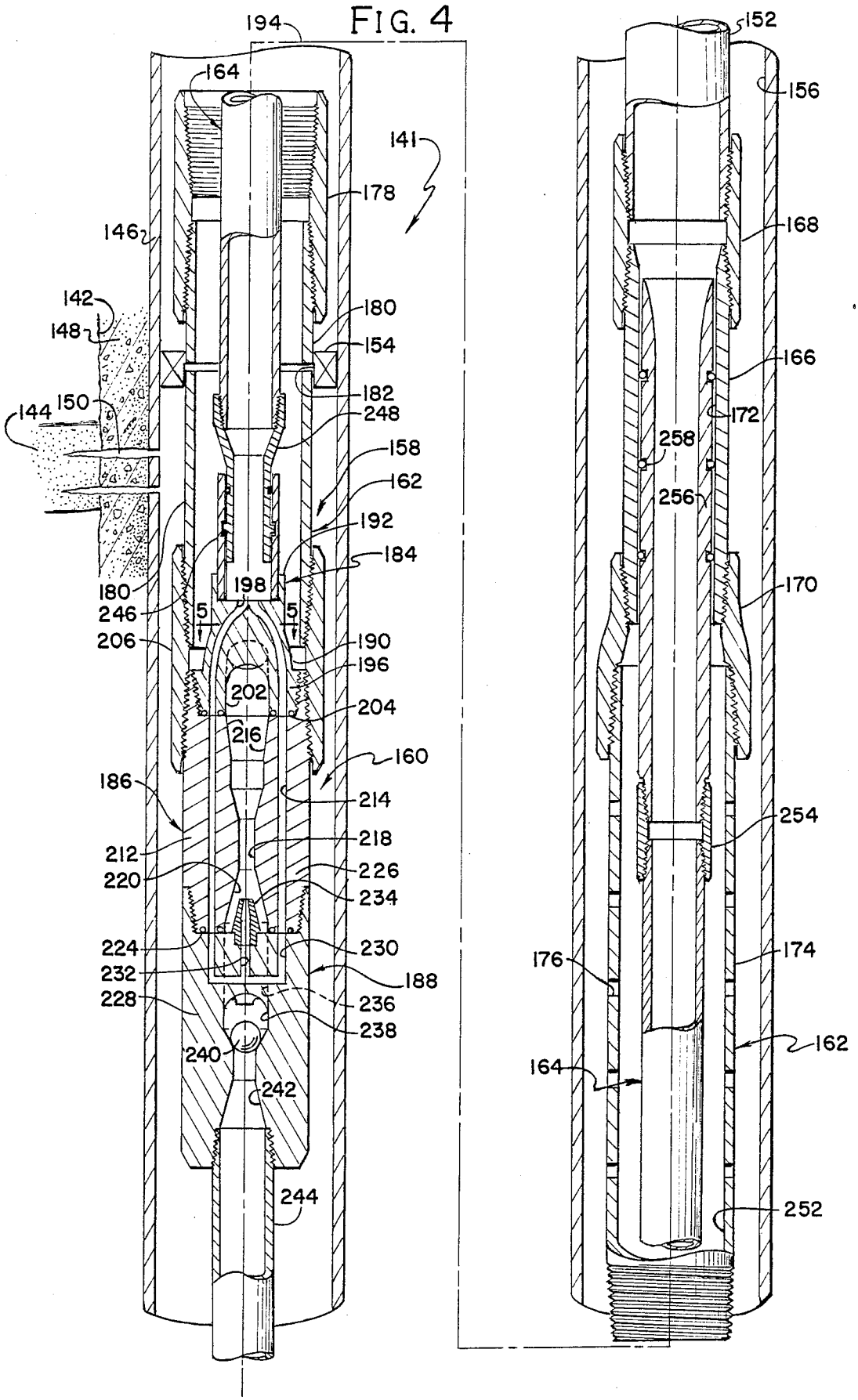
FIG. 4 is an enlarged cross-sectional view, similar to FIG. 2, illustrating another embodiment of this invention.

To provide this capability, the embodiment of FIGS. 4 and 5 includes a well 141 comprising a bore hole 142 extending into the earth to a depth sufficient to penetrate an oil productive subterranean formation 144. A casing string 146 has been cemented in the bore hole 142 with a cement sheath 148 in a conventional manner. After the casing string 146 has been cemented, a conventional perforating gun (not shown) is used to provide a series of perforations 150 communicating between the formation 144 and the interior of the casing string 146.

A tubing string 152 is run into the well 141 having a packer 154 adjacent the lower end thereof. The tubing string 152 may include conventional API tubing joints having a pin on one end and a collar or the other. In the alternative, to produce a shallow oil productive formation, the tubing string 152 may comprise a conduit of organic polymeric material of considerable length. At present, polyethylene tubing is available in 500′ spools and such material may comprise suitable tubing for shallow well installations using the technique of this invention.

At the surface, the tubing string 152 is suspended from a well head (not shown) and connects to a surface installation (not shown) which may be substantially identical to that of FIG. 1. In the embodiment of FIGS. 4 and 5, the mixture of produced and power fluids are delivered upwardly through the annulus 156 between the casing and tubing strings 146, 152 and the power fluid is delivered downwardly through the tubing string 152. Mounted on the bottom of the tubing string 152 is a pump assembly 158 of this invention comprising a jet pump 160 below the packer 154 and first and second conduits 162, 164 extending between the jet pump 160 and the tubing string 152. The conduits 162, 164 deliver power fluid and the mixture of produced and power fluids through the packer 154 to and from the jet pump 160.

The sizes of the conduits 162, 164 may vary widely depending on the size of the casing string 146 and the desired capacity of the pump assembly 158. Typically, the conduit 162 comprises a polished bore receiver 166 of $2\frac{3}{8}''$ O.D. to match the size of the tubing string 152 and having a collar 168 threaded to receive the lowermost pin of the tubing string 152 and a threaded lower end received in the upper end of a combination collar 170 having an upper $2\frac{3}{8}''$ female end and a lower end sized to receive a $2\frac{7}{8}''$ pin. The polished bore receiver 166 is characterized by a polished internal surface 172 for purposes more fully explained hereinafter. Threaded into the lower end of the combination collar 170 is a perforated pup joint 174, conveniently $2\frac{7}{8}''$ O.D., having a series of apertures 176 therein providing a passage across the wall of the first conduit 162.

The lower end of the perforated joint 174 is received in a collar 178 having a stinger 180 threaded therein. In some packer installations, the stinger 180 may extend through a central passage 182 of the packer 154. In other packer installations, as shown in FIG. 4, an upper section of the stinger 180, typically $2\frac{7}{8}''$ O.D. tubing, threads into or onto an upper end of the packer 154 while a lower section of the stinger 180 threads into the lower end of the packer 154. Thus, the stinger 180 and the central passage 182 of the packer 154 provide a passage through the packer 154. It will be appreciated that the embodiment of FIG. 4, as heretofore described, is substantially identical to the embodiment of FIG. 2.

The lower end of the stinger joint 180 is threaded into the jet pump 160 comprising a crossover section 184, a throat-diffuser section 186 and an inlet section 188. The crossover section 184 includes a body 190 having an upper threaded end 192 of reduced radius relative to an axis 194, an intermediate frustoconical portion and a lower portion 196 having a set of male threads connecting the crossover section 184 to the diffuser section 186. The crossover body 190 provides a first power fluid passage 198 extending along the axis 194 from the upper threaded end 192 into the frustoconical portion. The first passage 198 bifurcates to provide a plurality of subpassages extending longitudinally relative to the axis 194 but spaced therefrom.

The crossover body 190 also provides a second fluid passage 202 extending along the axis 194 from the lower end of the body 190 into the frustoconical portion which bifurcates and opens to the exterior of the body 190 on the periphery of the intermediate portion as shown best by a comparison of FIGS. 4 and 5. A series of O-rings 204 seal between the crossover section 184 and the diffuser section 186.

The diffuser section 186 includes a body 212 having upwardly facing male threads received in a collar 206 securing the diffuser section 186 to the first conduit 162. The diffuser section 186 also provides a pair of first passages 214 communicating with the bifurcated ends of the passage 198 and extending longitudinally but spaced from the axis 194. The body 212 also provides a second passage for produced and power fluid comprising a diffuser 216, a throat 218 and a nozzle cooperating section including an upwardly converging section 220. A series of O-rings 224 seal between the diffuser section 186 and the inlet section 188 when coupled together by a lower threaded diffuser end 226.

The inlet section 188 comprises a body 228 providing a pair of first passages 230 communicating the passages 214 of the diffuser section 186 to a nozzle passage 232 having a nozzle 234 secured therein in any suitable manner, as by threading or swedging. A second group of passages 236 open through the top of the inlet section 188 and communicate with a chamber 238 having a check valve 240 therein. A passage 242 communicates between the bottom of the inlet section 188 and the chamber 238, may include a tail pipe 244, and comprises the suction inlet of the pump 160. As will be appreciated, the inlet section 188 may be made in threadably connected parts to be able to place the ball 240 in the chamber 238.

The inner conduit 164 may conveniently comprise a length of 1" O.D. tubing connected, in any suitable manner, to the small upper end 192 of the crossover section 184. Although the conduit may be simply threaded onto the small upper end 192 of the crossover section, as in the embodiment of FIG. 2, it is preferred not to run concentric strings of tubing into the well 141. To this end, there is preferably provided a J-type lock receptacle 246, of the type shown in FIG. 3, on the upper crossover end 192 to receive a complimentarily configured pin 248 having seal assemblies thereon.

The tubing strings 162, 164 accordingly provide an annulus 252 communicating between the pump outlet passages 202 and the perforated joint 174 allowing a commingled stream of produced and power fluid to exit into the annulus 156. It will accordingly be seen that the first and second conduits 162, 164 provide a first passageway extending through the packer 154 for the downward movement of power fluid through the packer 154 and a second passageway through the packer 154 for the upward movement of produced and power fluid.

The upper end of the second conduit 164 is sealed relative to the first conduit 162 and the tubing string 152 in the sense that fluid in the conduit 162 and/or tubing string 152 does not enter the annulus 156. To this end, a collar 254 and sealing stinger 256 are provided on the upper end of the second conduit 164 to seal against the inner polished surface 172 of the polished bore receiver 166. The stinger 256 accordingly includes a series of annular circumferential grooves therein receiving packing assemblies 258.

Operation of the embodiment of FIG. 4 should now be apparent. The pump assembly 158 is run into the well on the bottom of the tubing string 152 and the packer 154 is landed at a location above the perforations 150. The lengths of the first and second conduits 162, 164 which extend below the packer 154 have been preselected to position the jet pump 160 at or preferably substantially below the lowermost perforation 150. It will be seen that the lengths of the first and second conduits 162, 164 may be substantial and are limited only by the friction losses which occur in the relatively small flow passages provided thereby. Thus, the jet pump 160 may be placed several hundreds of feet below the packer 154, which may be desirable when there is a long perforated productive interval in the well 10 as is common in many hydrocarbon producing areas of the world.

After the jet pump assembly 158 is in place in the well 140, power fluid is delivered downwardly through the tubing 152. The power fluid passes into the passage 198 of the crossover section 184, through the radially outwardly spaced passages 214 of the diffuser section 186 and then into the power fluid inlet passage 230 of the inlet section 188. The power fluid exits through the nozzle 234 and mixes with formation fluids in the throat 218. The mixed fluids then move upwardly through the diffuser 216 into the passage 202 and exit into the annulus 252 between the first and second conduit 162, 164. The mixed fluids then move upwardly, past the packer 154 and exit into the annulus 156 through the perforated pup joint 174. The mixed fluids then pass upwardly in the well 140 to the surface and are handled as in the embodiment of FIG. 2.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A well equipped to produce oil at the surface from a subterranean formation including a casing string cemented in a well bore penetrating the earth to a depth below the formation, the casing string comprising perforations extending through the casing string into communication with the formation;

a packer sealed against the interior of the casing string above the formation;

a tubing string inside the casing string and providing therewith an annulus, the tubing string being connected to the packer and extending upwardly to the surface, the tubing string and annulus providing a first upward path to the surface and a second downward fluid path from the surface; and a jet pump assembly including a jet pump below the packer comprising a body having an upper end, an outlet in communicating with the first fluid path, a nozzle section having a suction inlet below the packer and a power fluid inlet, means providing communication between the second fluid path and the nozzle section for delivering power fluid to the power fluid inlet and means connecting the upper jet pump body end to the tubing string comprising a J-slot receptacle secured to the upper jet pump body end having a J-slot therein, a tubular member connected with and communicating with the tubing string and having a J-slot pin on the lower end thereof removably received in the J-slot and means sealing between the J-slot receptacle and J-slot pin;

a first conduit including a receiver having a smooth interior passage comprising part of the tubing string, a perforated joint connected to the receiver and a stinger connected to the perforated joint extending through the packer to the jet pump; and a second conduit having a seal section sealingly engaging the smooth interior passage of the receiver and a conduit section secured to the seal section and extending inside the stinger and connected to the tubular member, the pump assembly providing a first passage through the conduit section and a second passage between the conduit section and the stinger.

2. The well of claim 1 wherein the tubing string comprises the first upward fluid path and the annulus comprises the second downward fluid path.

3. The well of claim 1 wherein the annulus comprises the first upward fluid path and the tubing string comprises the second downward fluid path.

4. The well of claim 3 wherein the jet pump assembly comprises a crossover section including a first passage having an axial upper section lying on a longitudinal axis of the jet pump assembly in communication with the tubing string and a lower section spaced from the longitudinal axis and a second passage having a lower section lying on the longitudinal axis and an upper section spaced from the longitudinal axis;

a diffuser section including an upwardly diverging diffuser, comprising the pump outlet, lying on the axis and in communication with the second passage lower section and a bypass spaced from the axis and in communication with the first passage lower section; and the power fluid inlet is in communication with the bypass, the means providing communication between the second fluid path and the nozzle section comprises the first passage in the crossover section and the bypass in the diffuser section.

* * * * *